United States Patent [19]

Wemmer

[11] 4,218,855

[45] Aug. 26, 1980

[54] PARTICULATE SPRAY NOZZLE WITH DIFFUSER

[76] Inventor: Otto Wemmer, 3710 Greenbriar Dr., Columbia, S.C. 29206

[21] Appl. No.: 967,750

[22] Filed: Dec. 8, 1978

[51] Int. Cl.[3] ..... B24C 5/04

[52] U.S. Cl. ..... 51/439; 239/343

[58] Field of Search ..... 51/439; 239/10, 343, 239/432, 590, 590.5

[56] References Cited

U.S. PATENT DOCUMENTS

| | | | |
|---|---|---|---|
| 391,865 | 10/1888 | Schutte . | |
| 1,988,432 | 1/1935 | Gillett et al. | 51/439 |
| 2,040,715 | 5/1936 | Smith . | |
| 2,559,592 | 7/1951 | Button et al. | 239/590 |
| 3,032,929 | 5/1962 | Glesener . | |
| 3,344,558 | 10/1967 | Kirkland . | |
| 3,510,065 | 10/1970 | Gigantino et al. | 239/590 |
| 3,693,884 | 9/1972 | Snodgrass et al. | 239/432 X |
| 3,828,478 | 8/1974 | Bemis . | |
| 3,841,568 | 10/1974 | Broad | 239/590 |
| 3,920,187 | 11/1975 | Willis . | |
| 3,994,097 | 11/1976 | Lamb | 51/439 X |
| 4,014,470 | 3/1977 | Burnham . | |
| 4,116,382 | 9/1978 | Clerk | 239/432 X |

*Primary Examiner*—Gary L. Smith
*Assistant Examiner*—Robert P. Olszewski
*Attorney, Agent, or Firm*—Pollock, Vande Sande & Priddy

[57] ABSTRACT

A particulate spray nozzle is disclosed having an internal mixing chamber with a liquid spray orifice on one side and a liquid and particulate discharge bore opening the opposite side to ambience. A liquid supply passage upstream of the orifice contains a disc-like diffuser with the plane of the disc parallel to and aligned with the longitudinal axis of the orifice. The diffuser is spaced axially from the orifice and the orifice is spaced axially from the discharge bore for causing a high pressure liquid to be discharged from the orifice in the form of a narrow gradually diverging spray which picks up particulate material in the mixing chamber and propels it out of the discharge bore by uniformly engaging only the outer most portion of the discharge bore. The apparatus can function as an abrasive blasting assembly or a chemical foaming gun. A method of discharging particulate materials, which may be either solid or liquid, is also disclosed.

32 Claims, 9 Drawing Figures

PARTICULATE SPRAY NOZZLE WITH DIFFUSER

BACKGROUND OF INVENTION

This invention relates to particulate discharging apparatus, and more particularly to an apparatus and method for discharging a particulate material at relatively high velocities using a highly pressurized liquid as the propellant.

In the art of sandblasting, air, steam and water have been used to provide the motive power for propelling sand or other abrasive against the surface to be cleaned. The use of water is believed to be more economical and advantageous than the use of air or steam. Water prevents the abrasive from rebounding from the abraded surface and forming a dust cloud. Water can also be used to carry the abrasive to a point of collection for reuse. In addition, it is often less expensive to generate the kinetic energy required by pressurizing water rather than steam or air, particularly for portable units.

One prior art method of liquid blasting is shown in U.S. Pat. No. 2,040,715 to Smith. This patent uses a solid pencil-like stream of water to propel a sand and air mixture out of the discharge bore of a blast gun. In this system, the water stream is too dense to mix well with the sand and the vacuum available for drawing in the sand is relatively low because the composite stream does not contact the discharge bore all the way around its periphery. Such systems usually do not produce a vacuum of more than 10 to 12 inches of mercury.

Another prior art sandblasting assembly is illustrated in U.S. Pat. No. 3,994,097 to Lamb. There, the water nozzle employs a tapered orifice bore to produce a diverging water spray instead of a solid water stream. The resulting spray pattern is so wide that it contacts the downstream blast nozzle over a large surface area. The composite stream generated by this type of apparatus lacks the motive power required for full impact velocity and effectiveness. The vacuum available for pulling in and mixing abrasive particles with the water spray is also limited by the lack of motive power of this stream. Although the vacuum attainable according to Lamb is around 22 inches of mercury, this is still substantially less than a full vacuum. For purposes of this specification, a vacuum is considered "full" when it is within 1 or 2 inches of mercury of an absolute vacuum.

Instead of using a tapered orifice bore, efforts have also been made in the prior art to improve the sand drawing suction of blasting nozzles by peening or otherwise shaping the orifice of the water nozzle to provide spray patterns of various shapes. In some cases both the water orifice and the discharge bore have been shaped as shown in U.S. Pat. No. 3,828,478 to Bemis. As the pattern of the water spray is highly sensitive to variations in the cross-sectional shape of the orifice, it is extremely difficult to consistently match the spray pattern to the shape of the discharge bore by non-circular shaping of the orifice. It is therefore seldom possible to obtain full and uniform contact between the spray and the discharge bore by this technique. Furthermore, irregular orifice shapes can impede flow within the orifice and decrease the exit velocity of the liquid flowing therethrough. In other words, small variations in forming a non-circular orifice bore can cause large distortions and turbulence in the water spray pattern.

It is therefore apparent that the liquid pressure nozzles of the prior art do not produce the optimum interaction between water spray and discharge bore for propelling particulate material. As discussed above, liquid streams generated by prior art devices contact either too much surface area or too little of the discharge bore periphery. The present inventor has found that too little contact fails to generate the vacuum necessary for effective feed rates and complete mixing and uniform dispersion of the particulate matter within the water stream, and that too much contact slows down the velocity of the liquid stream and fails to generate the motive power required for propelling the particles effectively.

Few, if any, prior art nozzles of the particulate blasting type have adequate mixing and sufficient discharge velocity for use as chemical foaming nozzles. Chemical foaming in the past has usually required a special nozzle of rather complex design for mixing the foaming ingredient with the propelling liquid and aerating the mixture.

SUMMARY OF INVENTION

Such disadvantages and limitations of the prior art are overcome by the particulate spray apparatus of the present invention. The liquid pressue nozzle disclosed cooperates with the discharge bore of the blasting nozzle to create a full vacuum in the mixing chamber while at the same time maximizing impact velocity of the propellant and particulate mixture. The inventor has recognized that large areas of contact and relatively large or high angles of impact between the propellant spray and internal surfaces of the discharge housing or nozzle cause excessive wall friction and spray rebound turbulence and that this can reduce the velocity of the water stream after it leaves the orifice by as much as 25% or more. This loss of motive power substantially impairs the ability of the spray to draw a vacuum and produce good abrading action. Much of the effective work energy of the high pressure fluid is thereby lost.

The mixing chamber of the spray apparatus has a liquid discharge orifice on one side and a spray and particulate discharge bore on the opposite side. The liquid supply passage upstream of the orifice contains a diffuser comprised of a solid body in the general form of a chip or disc with its major plane aligned substantially parallel to the longitudinal axis of the orifice. The chip or disc, which may have various shapes, cooperates with the walls of the passageway to divide the flowing liquid into a plurality of channels that come together immediately upstream of the entrance to the bore of the orifice. The diffuser is spaced axially from the orifice and the orifice is spaced axially from the discharge bore for causing liquid forced through the orifice under high pressure to form a gradually diverging spray which passes through the mixing chamber and out of the discharge bore. The spray pattern produced by the diffuser engages only the outer most portion of the discharge bore at a relatively small or low impact angle relative to its surface. The method of using such interaction between components to propel particulate materials at high discharge velocities is also described.

The apparatus and method of the invention produce a finely atomized liquid spray which diverges only gradually (about five degrees or less) so that a relatively dense pattern of droplets is maintained both within and external to the apparatus. Since the spray stream contacts the discharge bore only near its open end and with very little angle of impact (about two to three degrees), there is relatively little wall friction or fluid rebound and the exiting stream maintains substantially the full velocity produced by the pressure differential between liquid in the pressure nozzle and ambience. In addition, both the orifice and the discharge bore are cylindrical in shape and the spray pattern has the shape of a right circular cone such that the spray stream completely fills the outer end of the discharge bore and contacts the bore surface uniformly around all 360 degrees of its periphery. Such engagement of the bore periphery by the dense liquid spray of the invention produces a full vacuum of up to and exceeding thirty (30) inches of mercury relative to ambient pressure.

The high vacuum created can draw in a wide variety of particulate feed materials, such as particles of solid abrasive or droplets of liquid foaming agent, and results in high feed rates. Although relatively dense, the spray is well atomized into individual droplets of liquid so that the particles of the second or added ingredient become fully mixed with and uniformly dispersed in the spray stream before it is discharged externally to the apparatus. Another advantage of high vacuum is that plugging is not a problem. Plugging may occur where the abrasive inlet into the mixing chamber is positioned below the point at which water is introduced such that water may flow into the abrasive inlet when the device is shut off. The abrasive is thereby wetted and this can cause a plug of cohesive material to form in the inlet. The vacuum of the present invention is such that the plug is immediately pulled out of the inlet, dispersed in the chamber and discharged by the water stream as soon as the apparatus is turned on.

Where the added ingredient is an abrasive, the high discharge velocity of the composite mixture yields full velocity impact and rapid abrading action on surfaces of a work piece. Furthermore, after leaving the discharge bore and within 18 to 24 inches of its open end, the diameter of the composite stream stops increasing after attaining a maximum of approximately two inches. The stream thereafter maintains approximately a cylindrical shape until it dissipates with distance (about 25 feet). For this reason, the abrasive stream of the present invention has almost the same high impact characteristics as a solid stream of water with the added advantages of high vacuum and uniform dispersion of the abrasive. The extremely active and precise abrading action that results is capable of rapidly cleaning a variety of surfaces and allows more control than conventional sandblasting methods.

The inventor has also found that the high velocity and uniform mixing provided by his invention produces a composite spray that is unusually active and effective as a foaming medium where a foaming agent is used in place of an abrasive as the added ingredient. A very rich foam of high consistency is generated by rigorous interaction between the agent laden spray and the air through which it passes upon exiting the discharge bore of the apparatus.

It is therefore an object of the present invention to provide a sandblasting nozzle capable of using high pressure water or other liquids to generate full vacuum for mixing abrasive with the liquid and to propel the composite mixture at full velocity against the surface of a work piece to be abraded.

Another object of the invention is to provide a high pressure discharge nozzle capable of thoroughly mixing either a liquid or solid chemical foaming agent with a liquid propellant stream and ejecting the mixture external to the apparatus with a vigorous foaming action.

A further object of the invention is to provide a pressure nozzle having a liquid spray pattern capable of producing full vacuum within and full impact velocity external to a particulate discharging apparatus.

A still further object of the invention is to provide a liquid spray nozzle capable of cooperating with the mixing chamber and discharge nozzle of a particulate spray apparatus so as to minimize spray rebound from and wall friction with internal apparatus surfaces.

Yet another object of the invention is to provide a particulate spray apparatus capable of creating a particulate stream of solid or liquid particles, or both, and thoroughly mixing the particulate stream with a motive fluid for discharge external to the apparatus at high velocity.

A further object of the invention is to provide an abrasive blasting apparatus wherein abrasive dust is eliminated by thorough mixing of the abrasive with a particulate water stream.

Another object of the invention is to provide a liquid spray apparatus capable of discharging a large quantity of particulate material per unit of motive liquid.

A further object of the invention is to provide a particulate discharging nozzle capable of discharging a liquid chemical agent in a composite spray having a liquid chemical to liquid propellant ratio of 1 to 1 or greater.

Another object of the invention is to provide an abrasive blasting apparatus capable of abrading a hard surface at a high rate.

Yet another object of the invention is to provide a chemical blasting apparatus capable of cleaning dirty or stained surfaces at a high rate.

A further object of the invention is to provide a particulate discharging method in which a relatively small quantity of high pressure liquid can be used to propel a relatively large quantity of particulate material of various types at a velocity substantially unimpeded by contact with surfaces of an apparatus employing the method.

Numerous other objects and advantages of the invention will become apparent to those skilled in the art from this specification and the attached drawings.

BRIEF DESCRIPTION OF THE DRAWINGS

The invention, both as to its structure and method of operation, may be further understood by reference to the detailed description below taken in conjunction with the accompanying drawings in which.

DETAILED DESCRIPTION OF THE INVENTION

Figure 1:
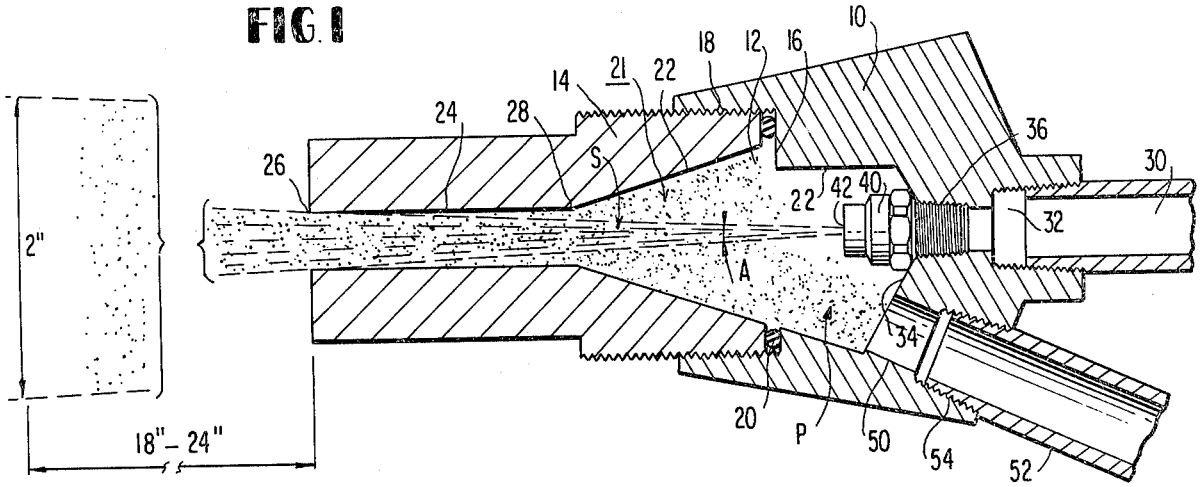
FIG. 1 is an elevational view of the invention in partial cross section.

One embodiment of the particulate spraying or discharging apparatus of the present invention is shown in FIG. 1 of the drawings. The apparatus is comprised of a blast nozzle assembly having a housing 10 defining an internal mixing chamber 12. The housing preferably includes a discharge nozzle 14 at the downstream side of chamber 12. The base of nozzle 14 is secured within a housing bore 16 by means of cooperating threads 18 between the nozzle and the housing and is seated against a gasket 20 of resilient material which serves as a seal against ambient pressure. It is to be understood however that the discharge nozzle may be integrally formed as part of the housing. The discharge nozzle 14 has a passage 21 extending therethrough. The passage includes an upstream tapered portion 22, which forms part of the chamber 12, and a downstream discharge bore 24 open to ambience at 26. Discharge bore 24 is preferably of uniform (constant) diameter and joins the tapered upstream portion at a bore inlet 28.

A pressure conduit 30 is threaded within a housing passageway 32, the downstream end of which joins an upstream sidewall 34 of chamber 12 through a threaded aperture 36. Sidewall 34 is generally opposite to the downstream chamber sidewall formed by tapered portion 22 of the discharge nozzle. Threaded within aperture 36 is a liquid pressure nozzle 40 having a spray outlet or orifice opening 42 which opposes and is aligned with bore 24 of discharge nozzle 14. The internal features of the pressure nozzle and the relationship between the orifice 42 and discharge bore 24 are discussed in greater detail below.

The housing 10 also includes a suction inlet 50 having one end secured to a suction conduit 52 by threads 54 and the other end communicating with housing chamber 12. The conduit 52 and the inlet 50 serve to supply particulate material "P" to the chamber 12 in response to chamber vacuum as hereinafter described.

Figure 2:
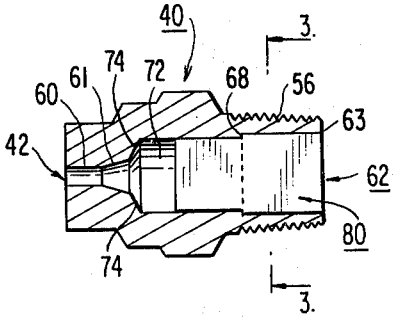
FIG. 2 is a cross section of the pressure nozzle of the invention illustrating structural features of the liquid passage and of the diffuser element positioned therein.
Figure 3:
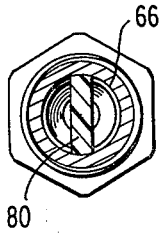
FIG. 3 is a cross section of the pressure nozzle and diffuser taken along line 3—3 of FIG. 2.
Figure 4:
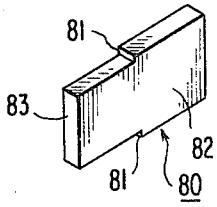
FIG. 4 is a perspective view of the diffuser element of FIGS. 2 and 3.

With reference to FIG. 2, the pressure nozzle 40 is secured in the outlet of housing passage 32 by threads 56 which engage passage threads 36. The outlet of pressure nozzle 40 is in the form of an orifice, generally designated 42, having a bore 60 preferably of uniform diameter and a tapered entrance portion 61. Passing through the nozzle along its longitudinal axis is a central passageway, generally designated 62. At the upstream end of passageway 62 is an inlet 63 communicating with housing passage 32, passageway 62 connecting housing passage 32 to mixing chamber 12 through outlet orifice 42. Between inlet 63 and orifice 42 is a diffuser chamber 66 having a shoulder 68 which serves as a retaining stop for a diffuser element 80. The shoulder 68 cooperates with a pair of shoulders 81—81 on diffuser body 82 to keep the downstream end 83 of the diffuser element 80 axially spaced from the orifice entrance 61. This spacing provides a recombining zone 72 between the downstream end of the diffuser and the upstream end of the orifice bore. The recombining zone allows fluid divided into two or more separate channels by the diffuser body 82 to recombine or join in a single channel prior to entering the orifice bore.

The housing shoulder 68 and diffuser shoulders 81—81 are preferably positioned to avoid any abutment between the diffuser body and the entrance to the orifice as such may reduce the velocity of liquid flowing therethrough. The orifice taper 61 leading to bore 60 facilitates a smooth transition of the flow as the liquid is forced into small cross sections. The downstream end of recombining zone 72 has a similar taper 74 surrounding the entrance to the orifice taper. Although the elongated orifice bore 60 may be tapered slightly due to manufacturing variances, it is preferably of a substantially uniform diameter.

The diffuser element 80 will now be described. The inventor has found that a relatively thin chip or disc shaped element positioned as shown in FIG. 2 will cause a high pressure water stream flowing through a small orifice of substantially uniform diameter to gradually diverge at an angle of divergence of about five degrees or less. The resulting spray cone is comprised of finely atomized water droplets confined at relatively high density within a narrow cone pattern. The diffuser cooperates with a circular orifice to precisely shape the spray pattern in the form of substantially a right circular cone. Without the diffuser, such an orifice produces a solid pencil-like stream of liquid without significant divergence as opposed to a spray of discrete liquid droplets. The diffusers of the present invention convert the solid liquid stream into a spray cone of the shape indicated with the cone comprised of finely atomized and uniformly dispersed water droplets.

Figure 5:
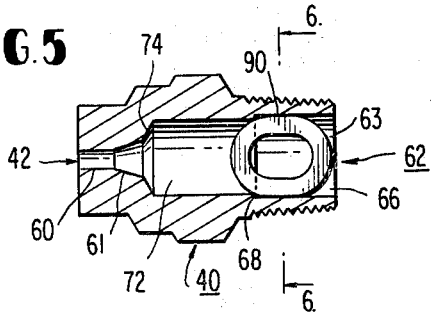
FIG. 5 is a cross section of the pressure nozzle illustrating a modification of the diffuser element.
Figure 6:
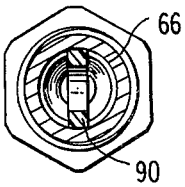
FIG. 6 is a cross section of the pressure nozzle and modified diffuser taken along line 6—6 of FIG. 5.
Figure 7:
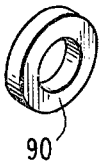
FIG. 7 is a perspective view of the modified diffuser element of FIGS. 5 and 6.

The most preferred form of the diffuser is the solid chip or thin plate structure shown in FIG. 2. With reference to FIG. 5, another preferred form of the diffuser is a disc-like shape comprised of a thin ring 90 of solid material. The wall thickness of the material is approximately equal to the width of the ring in the direction of its radial axis. Such a ring can be readily formed by cutting a tube of desired wall thickness transversely to the longitudinal tube axis such that the width of the cut piece is approximately equal to its thickness. The ring type diffuser is preferably made of a flexible resilient material cut from a round tube and compressed into the oval shape shown in FIG. 5 by confinement within the chamber 66. As used in this specification, the major axis of the ring diffuser refers to the longest axis of the oval shape and the minor axis refers to the smallest axis of the oval shape. The ring is preferably positioned with its major axis parallel to and in alignment with the longitudinal axis of the orifice bore. This alignment is achieved in the embodiment shown by making the diffuser chamber of circular cross section with a diameter less than the undeformed diameter of the ring. Deformation of the resilient ring results in frictioned engagement between the ring perimeter and the chamber surface. The cooperation between the two shapes also automatically centers the ring so that its plane intersects with the longitudinal chamber axis which in turn is aligned with the longitudinal axis of the orifice bore. In this way, the resiliency of the ring material both centers the diffuser within its chamber and holds it in position against the nozzle shoulder 68. However, it is to be understood that the ring need not be compressed into an oval, but may be circular in cross section or of oval shape with its major axis perpendicular to the axis of the orifice.

Figure 8:
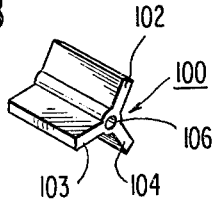
FIG. 8 is a perspective view of another embodiment of the pressure nozzle diffuser element.
Figure 9:
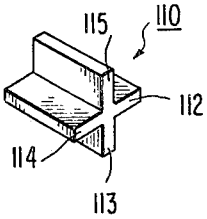
FIG. 9 is a perspective view of yet another embodiment of the pressure nozzle diffuser element.

Similarly, the body of the disc may be of a solid circular or oval shape. Also other shapes which divide the flow passageway into two or more channels are operable, although they may vary the cone shape somewhat away from a right circular cone and increase its divergence by two or three degrees. Two such shapes are illustrated by the diffuser bodies 100 and 110 of FIGS. 8 and 9, respectively. Body 100 has three centering fins 102, 103 and 104 and a central flow channel 106. Body 110 has fins 112, 113, 114 and 115 for dividing flow into four separate channels (as does body 100).

Without intending to be bound by any particular theory, it is believed that by dividing the flow into two or more channels and then recombining the separated fluid portions into a single channel, fluid turbulence or other fluid activity is produced which interacts with the orifice bore to atomize the fluid upon its discharge from the bore outlet. Where the orifice bore is substantially straight, the resulting spray pattern gradually diverges at an angle "A" of about five degrees or less as illustrated in FIG. 1. However, it should be understood that this angle may vary one or two degrees up or down depending upon mechanical tolerances and manufacturing variances within the orifice bore and its outlet opening. Thus, slight tapering of the orifice bore or variations in its length or shape may cause the liquid spray to be widened or narrowed by small amounts. Such variations do not significantly affect operation of the discharging apparatus as a whole since the pressure and discharge nozzles can be adjusted relative to each other to accommodate spray divergence angles in the range of three to seven degrees.

The following examples are illustrative of preferred constructions. Where the diameter of the diffuser chamber portion of the pressure nozzle passageway is 9/32 inch, a diffuser chip of that width is cut from a sheet of impervious material, preferably nylon, having a thickness of about 70 mils. Retaining shoulders 81 are cut about 1/64 inch deep across each side of the chip. Alternatively, a diffuser ring 5/16 inch in diameter is cut from a nylon tube having that outside diameter and a wall thickness of about 70 mils. The ring is cut at a width approximating its thickness, namely 1/16 inch. When the ring is compressed into the diffuser chamber diameter of 9/32 inch, the diffuser ring is extended along the longitudinal axis of the passageway to yield an oval shape with a major dimension of approximately 11/32 inch. The annular stop or shoulder 68 within diffuser chamber 66 has a radial depth of about 1/64 inch and is spaced axially upstream of the orifice to retain either the chip or the ring at least ⅛ inch from the entrance to the orifice bore. Where the liquid is water, a preferred diameter and length for the orifice bore are approximately 0.060 inch and ⅛ inch, respectively.

The water pressure nozzle is positioned within the housing 10 with the outlet orifice 42 spaced axially opposite the discharge bore 24. The axial distance betweening orifice 42 and the open end 26 of the discharge bore is such that the spray cone engages only the outer portion of the discharge bore. Since the cone is centered, the area of engagement extends around all 360 degrees of the bore periphery.

For example, if the discharge nozzle used with the pressure nozzle previously described is 3 inches long with about a 1 inch tapered portion and a discharge bore about 2 inches in length and 5/16 inch in diameter, the water spray will first engage the discharge bore approximately ½ inch upstream of the opening 26 where orifice 42 is spaced back from opening 26 by a distance of about 3½ inches. In this embodiment, sufficient mixing space is provided within chamber 12 by a housing bore having an internal diameter of approximately 13/16 inch.

Although the contact area is sufficient to prevent the in leakage of ambient air, it is not large enough to significantly decrease the exit velocity of the spray stream. There is sufficient contact to maintain a full vacuum where the gradually diverging spray cone uniformly engages the discharge bore for only a short distance upstream of the discharge opening 26. For this reason, the length of the bore may be relatively short. However, contact length should be at least ⅛ inch to insure adequate vacuum. To avoid significant rebound turbulence, initial contact should not be closer to the beginning of the constant diameter bore than about 10% of the bore length. Continuous engagement of a bore surface area corresponding to contact lengths from the end of the bore in the range of about ⅛ to ½ inch are preferred to provide the desired level of vacuum within mixing chamber 12. On the other hand, this relatively small area of contact in combination with the relatively small angle of impact (1.5 to 3.5 degrees) does not significantly reduce the velocity of the composite spray as it passes through discharge bore 24 and out of opening 26. The particular arrangement described above for ½ inch of contact length has produced a vacuum in chamber 12 in excess of 29 inches of mercury.

Such high vacuum readily draws the particulate ingredient "P" through conduit 52 and into the chamber 12 where it is rapidly and fully mixed with the particles of the liquid spray "S" as also illustrated in FIG. 1. Upon leaving the discharge opening 26, interaction between the atmosphere and the spray is such that after traveling a short distance from exit opening 26 (approximately 18 to 24 inches), the spray attains its maximum diameter (approximately 2 inches). Thereafter, the spray diameter remains constant until its speed dissipates with distance (about 25 feet) or upon contact with the work piece.

The particulate spray apparatus of the present invention is particularly effective as a sandblasting unit where the particulate material is an abrasive such as sand. With a water propellant, the device operates effectively over a pressure range from as low as 400 pounds per square inch to as high as 20,000 pounds per square inch or more, the upper pressure being limited only by equipment design. Full vacuum is attainable throughout this pressure range. Such high vacuum is very useful for discharging mixtures of sand and air. For an orifice flow rate of 2 gallons per minute at 1,000 pounds per square inch pressure, the device is capable of drawing at least 400 pounds of sand per hour. Increasing the pressure to 1,950 pounds per square inch and the water flow rate to 5 gallons per minute, sand can be discharged at the rate of about 900 pounds per hour. In addition to larger sand flow rates, the impact of the abrasive particles against the work piece is much higher than previously attainable. The abrading action is further enhanced by uniform dispersion of the abrasive particles throughout the impacting stream of the spray.

The present invention is also highly effective in the application of foaming and other types of chemical agents. When used as a foaming nozzle, thorough mixing of a particulate foaming material with the propellant spray in the mixing chamber and subsequent discharge of the composite spray at high velocity produces rigorous foaming action external to the apparatus. Rapidly expanding foam is generated after several inches of travel beyond the discharge opening 26. The foaming action is so rigorous that a heavy, rich foam resembling shaving cream is produced. One advantage of such thick foaming action is that a foamed cleaner can be made to cling to vertical and overhead surfaces, rather than running off without sufficient reaction or cleaning time. Furthermore, the high discharge volumes possible greatly reduce operator time required to cover a given surface area. Another feature of the apparatus is that the flow of cleaner through suction conduit 52 may subsequently be cut off and the high pressure water stream alone used to blast and rinse off foreign material loosened by the cleaner.

Still another important feature of the invention is that a liquid may be drawn directly through conduit 52 without prior mixing with air or other transport gases. The vacuum generated in mixing chamber 12 is such that liquid at the end of the suction conduit is rigorously torn into droplets by dissolved gases and vaporization of the liquid itself. Liquid agents can be pulled in so fast that the flow rate of this type of dispersoid is unusually fast. In some instances, a flow ratio greater than 1 part liquid dispersoid to 1 part liquid propellant can be achieved.

Thus, the present invention can apply chemical cleaning liquids of either the foaming or non-foaming type at extremely high speeds. For example, a chemical foam cleaner can be applied at the rate of 1 gallon of cleaner per 5 gallons of water per minute. It is believed that such rates of coverage have not heretofore been attainable with a foam cleaner. For purposes of cleaning excess mortar from newly built walls, the invention is capable of applying muriatic acid at speeds in excess of a ratio of 1 part muriatic acid to 1 part water propellant. When this feed ratio is combined with a five gallons per minute pressure nozzle, enormous areas can be soaked with the mixture to loosen excess mortar for subsequent removal. Removal can then be accomplished using the high pressure water stream alone, the impact velocity of the water droplets readily removing the loosened mortar.

Other uses of such a high impact spray nozzle will be readily apparent to those skilled in the art. By way of further example, the spray apparatus can be used to apply aluminum brightener at unprecedented speeds. The time needed to clean aluminum trailer rigs is thereby reduced to a fraction of that previously required. Another application is the projection of seeds into the soil of a freshly plowed field or past intervening layers of foliage for planting unplowed areas. The spray apparatus of the present invention can thus discharge many different types of particulate materials, whether solid or liquid, for application to a wide variety of work surfaces.

The foregoing specific embodiments are merely exemplary of the various embodiments possible and the true scope of the invention is not to be limited to those embodiments but is defined by the claims at the end of this specification. Other embodiments and modifications of the apparatus and method of the invention will be apparent to those skilled in the art from consideration of this disclosure as a whole. Thus, the materials of the various components of the apparatus may be varied as compatible with the particular materials to be discharged and the flow and pressure parameters employed. Where high liquid pressures are employed, the pressure nozzle and components upstream thereof are preferably of a high tensile steel or other material of similar tensile strength. Where the particulate material is abrasive, the discharge nozzle should be of a hard, wear resistant material such as tungsten carbide. Similarly, the materials selected for the nozzles and other components of a chemical discharge apparatus should be resistant to the corrosive action of the chemicals to be employed. Plastic materials may therefore be preferable in many applications.

It should also be understood that the diffuser element may be varied in shape. Thus, the chip or disc employed may take almost any thin, flat shape capable of dividing the liquid flow into two or more channels upstream of the orifice bore. The central portion of the shape may be hollowed out in the form of a non-circular or non-symmetrical ring of material. Similarly, the diffuser may be flexible or rigid and made from a wide variety of materials, including metals, plastics, and ceramics.

In addition, a number of changes can be made in the dimensions and other parameters of the various components without changing the functional relationships embodied in the invention. All such embodiments, modifications and variations are contemplated by this invention.

What is claimed is:

1. A particulate discharging apparatus comprising:

housing means defining a mixing chamber with an upstream side and a downstream side, said housing means including an elongated discharge bore having an entrance at one end communicating with the downstream side of said chamber and the other end open externally to said housing means;

pressure nozzle means having a liquid passage extending therethrough between an inlet for delivering a liquid under pressure into said passage and an outlet orifice for discharging pressurized liquid from said passage into said mixing chamber, said orifice communicating with the upstream side of said chamber in spaced relation to said discharge bore;

diffuser means disposed in said nozzle passage, said orifice in the absence of said diffuser being adapted to discharge said pressurized liquid as a substantially solid stream without significant divergence and cooperating with said diffuser as disposed in said nozzle passage for causing said pressurized liquid to be discharged as a gradually diverging spray of discrete liquid droplets, said orifice cooperating with said discharge bore for causing said gradually diverging spray to pass through said discharge bore so as to produce a vacuum in said chamber; and, inlet means communicating with said chamber for delivering a stream of particulate material into said chamber in response to said vacuum, said chamber cooperating with said orifice for causing said spray to intermix with said particulate material and propel the resultant mixture through said discharge bore.

2. The particulate discharging apparatus of claim 1 wherein said orifice is positioned relative to said discharge bore for causing the outer peripheral portion of said diverging spray to first engage the surface of said discharge bore near its said open end.

3. The particulate discharging apparatus of claim 1 wherein said gradually diverging spray engages at least a portion of said discharge bore substantially around its entire periphery and said engagement is such that the velocity of said liquid droplets is not significantly reduced.

4. The particulate discharge apparatus of claim 3 wherein the engagement between said diverging spray and said discharge bore first occurs one-eighth inch to one-half inch upstream of the open end of said discharge bore.

5. The particulate discharging apparatus of claim 3 wherein said discharge bore is of substantially uniform diameter.

6. The particulate discharging apparatus of claim 5 wherein the engagement between said diverging spray and said discharge bore first occurs at a distance downstream from the entrance of said discharge bore of at least about ten percent of the overall length of said discharge bore.

7. The particulate discharging apparatus of claim 6 wherein the length of said discharge bore is at least equal to the diameter of said bore.

8. The particulate discharging apparatus of claim 3 wherein said spray is in the form of a right circular cone diverging at an angle of between three and seven degrees.

9. The apparatus of claim 8 wherein said spray diverges at an angle of about five degrees or less.

10. The particulate discharging apparatus of claim 8 wherein the outer periphery of said spray first engages the surface of said discharge bore at an impact angle not exceeding three and one-half degrees.

11. The particulate discharging apparatus of claim 5 wherein said orifice is positioned relative to said discharge bore for causing said diverging spray to first engage said discharge bore at a location at least about one-eighth inch from its said open end.

12. The apparatus of claim 5 wherein a wall of said chamber surrounds the entrance of said discharge bore and said wall is tapered to converge toward said discharge bore.

13. The particulate discharging apparatus of claim 1 wherein the engagement between said diverging spray and said discharge bore first occurs substantially adjacent to the open end of said discharge bore.

14. The apparatus of claim 1 wherein said orifice comprises a substantially circular outlet opening preceded by a substantially cylindrical bore and said diffuser means cooperates with said orifice bore to provide a gradually diverging spray substantially in the shape of a right circular cone.

15. The apparatus of claim 1 wherein said diffuser means comprises a body dividing said nozzle passage into at least two separate channels, said multiple channels joining to form a single channel communicating with the bore of said orifice.

16. The apparatus of claim 15 wherein the axis of said passage is aligned with the longitudinal axis of said orifice bore.

17. The apparatus of claim 16 wherein said body comprises a rectangular chip positioned in said nozzle passage with the major axis of the rectangle approximately parallel to the longitudinal axis of said passage.

18. The apparatus of claim 16 wherein said body comprises an oval disc positioned in said nozzle passage with the major axis of the oval approximately parallel to the longitudinal axis of said passage.

19. The apparatus of claim 16 wherein said body comprises a hollow ring, the material of said ring being disposed in a plane passing approximately through the longitudinal axis of said passage.

20. The apparatus of claim 19 wherein said ring is oval in shape and is positioned in said nozzle passage with the major axis of said oval approximately parallel to the longitudinal axis of said passage.

21. The apparatus of claim 15 wherein said body is comprised of flexible material.

22. The apparatus of claim 21 wherein said flexible material is plastic.

23. The apparatus of claim 15 wherein said body comprises an elongated member extending longitudinally along and cooperating with the walls of said passage to form said at least two separate channels.

24. The apparatus of claim 23 wherein said elongated member has at least two substantially planar faces and is positioned so that said planar faces extend longitudinally along said nozzle passage in a plane approximately parallel to the longitudinally axis of said passage.

25. The apparatus of claim 24 wherein at least one edge of said planar faces abuts the wall of said passage.

26. The apparatus of claim 23 in which said elongated member has a central flow channel extending approximately along the longitudinal axis of said passage.

27. The apparatus of claim 26 in which said orifice includes an elongated bore of substantially uniform diameter and the axis of said nozzle passage is aligned with the longitudinal axis of said orifice bore.

28. A particulate discharging apparatus comprising:

housing means defining a mixing chamber with an upstream side and a downstream side, said housing means including an elongated discharge bore having one end communicating with the downstream side of said chamber and the other end open externally to said housing means;

pressure nozzle means secured to said housing means upstream of said discharge bore and having a passage extending therethrough, said nozzle means including an inlet for delivering a liquid under pressure into said passage and an outlet orifice for discharging pressurized liquid into said mixing chamber, said orifice comprising an elongated bore with its downstream end communicating with the upstream side of said chamber in opposing spaced relation to said discharge bore;

diffuser means disposed in said nozzle passage, said orifice in the absence of said diffuser being adapted to discharge said pressurized liquid as a substantially solid stream without significant divergence and cooperating with said diffuser as disposed in said nozzle passage for causing pressurized liquid to be discharged as a gradually diverging spray of discrete liquid droplets, said diffuser means including an elongated body extending longitudinally along and cooperating with said nozzle passage for causing liquid flowing therethrough to be divided into at least two separate streams and then recombined into a single stream prior to entering said orifice bore; and, inlet means communicating with said mixing chamber for delivering a stream of particulate material into said chamber, said orifice cooperating with said discharge bore for causing said diverging spray to be discharged from said discharge bore and to produce a vacuum for drawing particulate material into said chamber from said inlet means, and said orifice cooperating with said chamber for causing said diverging spray to intermix with particulate material drawn into said chamber and to dicharge the resultant mixture through said discharge bore.

29. The method of discharging particulate material with a liquid which comprises:

passing a pressurized liquid through a passage containing a diffuser means and out of an orifice adjacent to the downstream side of said diffuser means, said orifice in the absence of said diffuser means being adapted to discharge said pressurized liquid as a substantially solid stream without significant divergence and cooperating with said diffuser means as disposed in said nozzle passage to produce a narrow spray of discrete liquid droplets having a gradually diverging conical pattern;

passing said spray through a mixing chamber defined by walls of a housing, said chamber being larger than said spray pattern;

introducing particulate material into said spray within said chamber;

passing said particulate containing spray into a discharge bore, said discharge bore having an inlet with a diameter greater than said spray pattern and an open outlet;

contacting at least a portion of the surface of said discharge bore with said spray around substantially the entire bore periphery to produce a vacuum in said chamber sufficient to pull particulate material into said mixing chamber and intermix it with said spray, contact between said spray and the walls of said chamber being avoided and contact between said spray and said bore being such that the velocity of said spray is not significantly reduced; and, discharging said particulate containing spray out of said open bore outlet.

30. The method of claim 29 wherein the liquid is water and the particulate material is a solid abrasive.

31. The method of claim 29 wherein the liquid is water and the particulate material is a liquid foaming chemical.

32. The method of claim 29 wherein the propellant liquid is water and the particulate material is comprised of liquid droplets.

* * * * *